United States Patent [19]

Stevens et al.

[11] 4,264,399

[45] Apr. 28, 1981

[54] MATERIAL BRAKING APPARATUS

[75] Inventors: Samuel B. Stevens, Pekin; Richard W. Kizer, Morton, both of Ill.

[73] Assignee: Caterpillar Tractor Co., Peoria, Ill.

[21] Appl. No.: 89,122

[22] PCT Filed: Jun. 26, 1979

[86] PCT No.: PCT/US79/00450

§ 371 Date: Jun. 26, 1979

§ 102(e) Date: Jun. 26, 1979

[87] PCT Pub. No.: WO81/00096

PCT Pub. Date: Jan. 22, 1981

[51] Int. Cl.[3] ..... B65H 81/00

[52] U.S. Cl. ..... 156/425; 156/397; 156/429; 156/430

[58] Field of Search ..... 156/392, 397, 430–432, 156/425, 429; 242/4 B, 75.45, 67.5; 57/3, 13, 15, 18; 188/196 F, 196 V, 72.7, 72.8

[56] References Cited

U.S. PATENT DOCUMENTS

| | | | |
|---|---|---|---|
| 1,399,988 | 12/1921 | Pierce | 242/75.45 X |
| 1,409,505 | 3/1922 | Wheildon | 242/75.45 |
| 1,676,797 | 7/1928 | Nyman | 242/75.45 |
| 2,588,525 | 3/1952 | Hertenstein | 242/75.45 X |
| 2,592,595 | 4/1952 | Patterson | 242/75.45 |
| 3,486,317 | 12/1969 | Grawey et al. | 57/3 |
| 3,720,385 | 3/1973 | Staats | 242/75.45 |
| 3,864,188 | 2/1975 | Grawey et al. | 156/397 |
| 4,008,114 | 2/1977 | Lindsey | 156/392 |
| 4,069,088 | 1/1978 | Cottam | 156/392 |
| 4,145,243 | 3/1979 | Cottam | 156/392 |

*Primary Examiner*—David A. Simmons

*Attorney, Agent, or Firm*—Wegner, Stellman, McCord, Wiles & Wood

[57] ABSTRACT

A braking apparatus (36) is provided for a supply spool (30) whereby material (12) drawn from the spool (30) will have a relatively uniform tension. The braking apparatus (36) includes a follower roller (40) in contact with the material (12) on the spool (30) and a brake portion (38) in adjustably controlled braking contact with a brake rotor (102) mounted for rotation with the spool (30). The follower roller (40) follows the decrease in the diametral amount of material on the spool and simultaneously moves the brake portion (38) toward the center of the brake rotor (102) wherein a uniform braking force on the spool (30) is maintained. In one embodiment, the supply spool (30) is mounted on a shuttle (14) of a cable-winding apparatus so that as the shuttle (14) rotates, centrifugal force will act on the follower roller (40) to urge a roller (51) against the material (12) on the spool (30) and to move the brake portion (38) toward the center of the brake rotor (102) to maintain constant force on the material (12) being withdrawn from the spool (30).

12 Claims, 4 Drawing Figures

FIG. 1
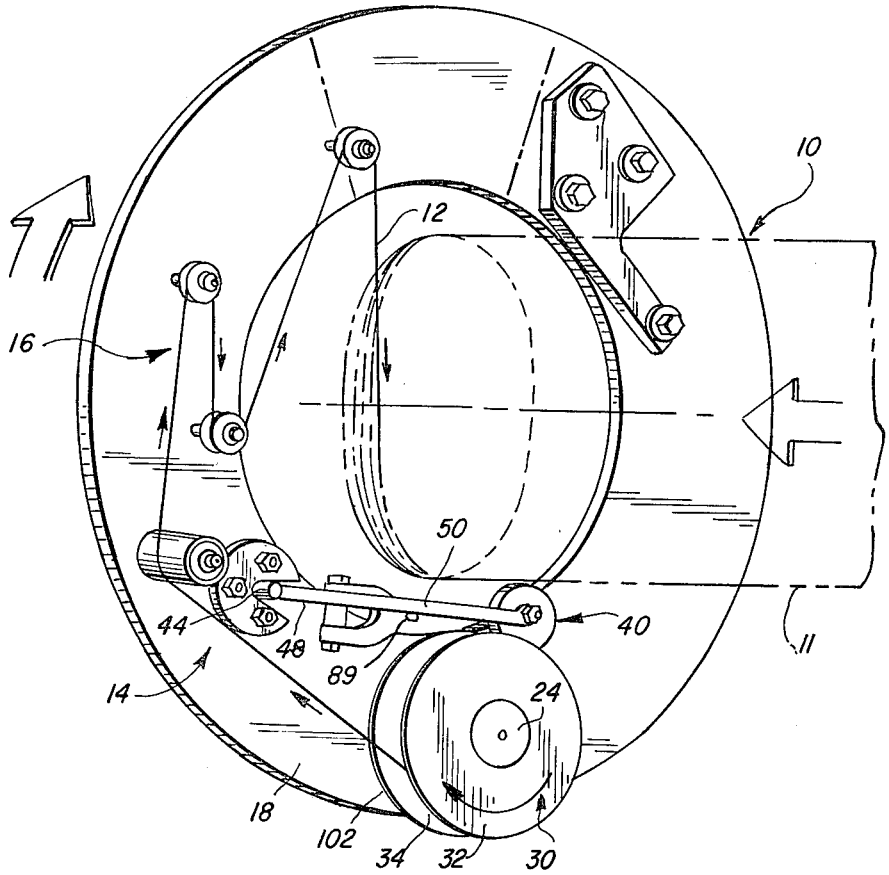
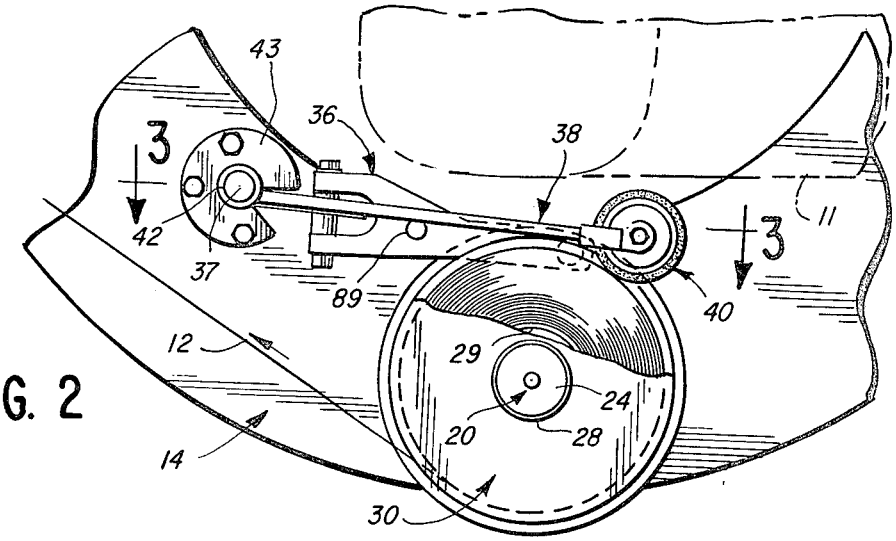
FIG. 2

MATERIAL BRAKING APPARATUS

DESCRIPTION

1. Technical Field

This invention relates to a braking apparatus and, more particularly, to an apparatus for applying a substantially uniform braking force to a rotating supply spool.

2. Background Art

Many different industries use equipment for winding a material, such as a cable, a ribbon or a strip, around a body for protection of the body, for insulation of the body, for strengthening of the body, and the like. The material is applied either by an applicator bearing against the body as the body is rotated, or is applied by a shuttle, or the like, radially encircling the body and rotating in a plane generally transverse to the body as the body is moved past the shuttle. In all such equipment, it is essential that the material, whether it be a cable, a ribbon of rubber, a strip of cloth or canvas, or the like, is maintained under tension as it is applied. The most desirable wraps are accomplished by maintaining the material under substantially uniform tension as it is applied.

One existing piece of equipment includes provision for wrapping the material around a brake roller just prior to passing the material over an applicator head as the applicator head applies the material to the body being wrapped. A brake pad bears against a brake rotor radially projecting from the brake roller for applying tension to the material being applied to the body. The brake pad always operates on the rotor along the same radially disposed band so that the braking force applied to the material does not vary no matter what demands are placed on the material being wrapped.

A second known applicator includes a brake rotor on a supply spool with brake pads bearing against the rotor to add resistance to the material drawn from the spool. The material encircles a roller carried by a lateral arm of a bellcrank lever which is pivoted at its center with the other arm of the bellcrank supporting the brake pads against the brake rotor so that as the tension on the material increases, it will pivot the bellcrank to move the pads radially inward toward the center of the spool. Spring means urge the bellcrank and the brake pads radially outward on the disc when the tension on the material slackens. The centrifugal force on the brake pads tends to urge the brake pads radially outward on the rotor, which force must be overcome by the tension in the material acting on the roller on the bellcrank lever.

A third apparatus is shown in U.S. Pat. No. 3,864,188 to Grawey et al, issued Feb. 4, 1975 and assigned to the common assignee of the present application, does not maintain a constant cable tension or velocity due to the variable rate of cable deposition. The cam follower has a variable lineal velocity due to the position of the follower on the cam profile. The extension spring loaded cam follower reacts to cam profile changes by applying or letting off brake pressure to the outside diameter of the cable spool. Based on the cam position, at a point of low cable demand, the cable reacts on the spring loaded brake lever arm which results in a braking force being applied to the cable spool which, in turn, lowers the cable take-off velocity and raises cable tension between the spool and cable applicator head. Thus, optimum cable tension and velocity is variable through the wrapping operation.

DISCLOSURE OF INVENTION

The present invention is directed to overcoming one or more of the problems as set forth above.

A material tensioning apparatus is provided for applying material radially around a body wherein the apparatus maintains uniform tension on the material as the material is withdrawn from a supply spool. The apparatus includes a follower which is centrifugally urged against the material on the supply spool and which follower will travel radially inward on the material as the material is dispensed from the spool. A brake is carried by the follower and has brake pads in braking engagement with a brake rotor carried by the supply spool so that as the material is discharged from the supply spool, the follower will track the diminishing supply of material and will move the brake pads radially inward on the rotor to maintain a uniform braking force on the material withdrawn from the spool.

BRIEF DESCRIPTION OF DRAWINGS

FIG. 1 is a perspective view of a shuttle shown schematically encircling a toroidal member for applying a cable to the toroidal member with a uniform tension maintained by the improved braking apparatus;

FIG. 2 is an enlarged, broken away, elevational view of the supply spool with the improved braking apparatus and follower illustrated in position thereon;

BEST MODE FOR CARRYING OUT THE INVENTION

Figure 3:
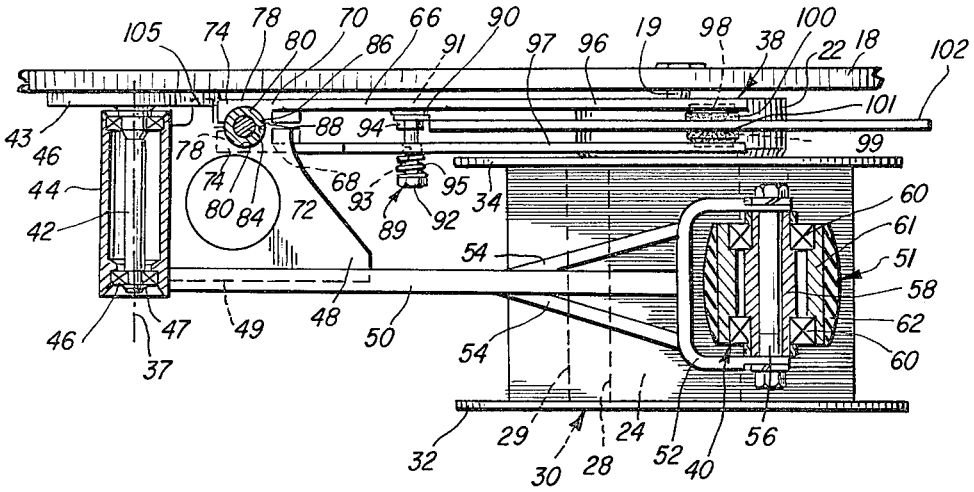
FIG. 3 is a cross-sectional view taken along the line 3—3 of FIG. 2; and, FIG. 4 is a further enlarged elevational view of the improved braking apparatus and follower in position on the supply spool.

Referring to FIG. 1, a toroidal member 10, in this case the carcass of a torus tube tire, is shown in phantom being rotated in the plane of a side wall 11 about an axis of the carcass extending perpendicular to the plane of the side wall 11. The toroidal member 10 could be a torus tire of the type shown and described in U.S. Pat. No. 3,606,921, issued to Charles E. Grawey and assigned to the common assignee of the present application. The toroidal member 10 has a continuous helix of inextensible cable 12 being wrapped around the body thereof, which cable 12 should have a substantially uniform tension and should be spaced from adjacent passes of the cable by a substantially uniform amount. The cable 12 is radially wound on the toroidal member 10 by means of a shuttle 14 which is rotatably driven about the body of the toroidal member 10 in a plane substantially perpendicular to the plane containing the side wall 11 of the toroidal member 10. The shuttle 14 is shown schematically as a closed ring wherein, in practice, the ring can be opened to permit adding and removing a carcass from the winding apparatus. The toroidal member 10 is rotated about the axis of the toroidal member as the shuttle 14 is rotated about the body of the toroidal member 10 which results in the cable 12 being laid up on the toroidal member 10 in a spiral or helical form. A structure, designated by the numeral 16, is provided on the shuttle 14 for applying cable 12 received from the supply spool to the toroidal member 10. The structure 16 includes elements for accommodating the application of the cable to the changing curvatures of the cross-sectional shape of the toroidal member 10.

The frame 18 of the shuttle 14 has a shaft 19 (FIG. 3) attached thereto and projecting transversely outward therefrom. A spindle 20 is rotatably mounted on the shaft 19 and includes an enlarged cylindrically-shaped hub 22 near the frame 18 and a spool-receiving portion 24 outboard of said hub 22. The spool-receiving portion 24 is adapted to nest in the hollow cylindrical sleeve 28 of a supply spool 30. Appropriate interconnecting means between the spool-receiving portion 24 and the sleeve 28 are provided whereby the spool 30 rotates with the spool-receiving portion 24 and with the hub 22 about the shaft 19 carried by the shuttle 14. The spool 30 has a concentric sleeve 29 spaced outward from the sleeve 28 and has a pair of spaced apart parallel side flanges 32 and 34 connected with the sleeves 28,29 to retain the material, in this case inextensible cable 12, wound on the sleeve 29 and between the flanges 32,34.

A braking apparatus 36 is pivotally mounted about an axis 84 which, in turn, is rotatably mounted about an axis 37 mounted on the shuttle 14 and is operative to add resistance to the rotation of the spool 30 so that cable 12 will have a predetermined loading or tension as it is drawn from the spool 30. The braking apparatus 36 includes a brake portion 38 and a follower portion 40, both of which are operatively interconnected to function together to uniformly tension the cable. Specifically, a pivot shaft 42 is affixed to a flange 43 bolted to the frame 18 and extends transverse thereto so that the axis 37 of the shaft lies parallel to the axis of the shaft 19. A sleeve 44 is rotatably mounted on the shaft 42 by bearings 46 and is held on the shaft 42 by a snap ring 47. A plate 48 is welded, or otherwise secured, to the sleeve 44 and extends outward from said sleeve 44. A rod 50 is secured to the sleeve 44 and to one edge 49 of the plate 48 and extends substantially radially outward from the sleeve 44. A follower roller 51 is mounted on the distal end of the rod 50 by a yoke 52 centrally secured to the end of the rod 50. The yoke 52 is braced against turning relative to said rod 50 by a pair of angle braces 54. A pivot 56 extends between the outboard ends of the arms of the yoke 52 and receives a stepped sleeve 58 on which a pair of spaced apart bearings 60 are seated for supporting a concentric sleeve 61 to which is secured a crowned resilient cover pad 62 to form the follower roller 51. The rod 50 with the roller 51 on the outer end thereof, pivots about the axis 37 of the shaft 42 with the surface of the pad 62 on the roller contacting the supply of material, in this case cable 12, wound on the spool 30.

The brake portion 38 of the braking apparatus 36 is comprised of a pair of spaced levers or arms 66 and 68, each one of which has a bifurcated end portion 70 and 72, respectively. The spaced legs 74 and 76 of each bifurcated end portion 70 and 72 have transversely enlarged portions 78 containing cylindrical cutout portions 80. When the levers or arms 66 and 68 are mounted facing each other, the cylindrical cutout portions 80 of each pair of legs 74,74 and 76,76 will face each other and will bear against a sleeve 82 surrounding a bolt 84 threaded into each end of a spacer 86 extending between the spaced legs 74,76 of the levers 66,68. A washer 87 is positioned between the head of each bolt 84 and each sleeve 82 to enlarge the supporting surface overlapping the legs 74,74 and 76,76. The spacer 86 nests in a semi-circular aperture 88 in the edge of the plate 48 and is secured to said plate 48 along the edge of said semi-circular aperture 88. The legs 74, 74 and 76,76 of the bifurcated end portions 70,72 of the levers or arms 66 and 68 straddle the plate 48 and engage with the sleeves 82 and spacer 86 above and below the plate 48.

A load member 89 acts on the levers or arms 66 and 68 to apply a braking force to the spool 30. The load member 89 includes, intermediate the ends of the lever 66, a raised lug 90 which has a threaded aperture 91 lying on the axis transverse to the plane of the lever 66. An adjusting bolt 92 passes through an opening 93 in the lever 68 and is threaded into the threaded aperture 91 in the lug 90. A lock nut 94 is threaded to the bolt 92 and bears against the lug 90 to lock the bolt 92 in a set position. A spring 95 encircles the bolt 92 and rests between the head of the bolt 92 and the outer face of the lever 68 so as to urge the lever 68 and the lever 66 toward each other about the axis of the sleeves 82 in the bifurcated legs 74 and 76 of the levers. The outer end portions 96 and 97 of the levers 66 and 68 have recesses 98,99 in which brake pads 100, 101 are seated in alignment with each other. The brake pads 100,101 bear on opposite sides of a brake rotor 102 welded or otherwise securely fastened to the hub 22 on the spindle 20 supporting the spool 30. The brake rotor 102 rotates with the hub 22, with the spindle 20, and with the spool 30. The brake rotor 102 and the supply spool 30 rotate together about the common axis of the pivot shaft 19 supporting the spool 30. The brake pads 100,101 bear against opposite surfaces of the brake rotor 102 with the amount of braking force being adjustable by means of the bolt 92 and spring 95. Levers 66 and 68 engage with the sleeves 82 as the brake pads 100,101 engage with the brake rotor 102 in response to the adjustment of the adjusting bolt 92 so that the bolt 92, when tightened, will grip the levers 66 and 68 more securely against the sleeves 82 and will urge the brake pads 100,101 with a greater frictional force against the brake rotor 102.

Figure 4:
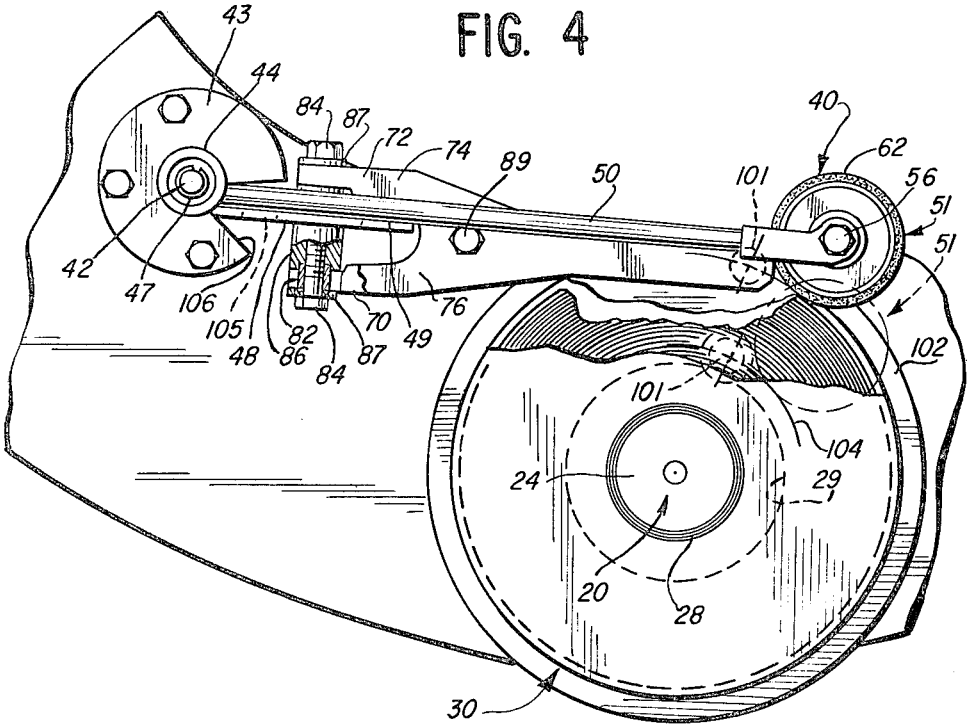

As can be seen in FIGS. 3 and 4, the common centerline of the brake discs 100,101 and the centerline of the roller 51 are substantially parallel to each other, so that the interconnected brake 38 and follower roller 40 will pivot about the axis 37 of the shaft 42 with the surface of the pad 62 of the roller following the surface of the supply of cable 12 on the spool 30 to establish the location of the brake pads 100,101 on the brake rotor 102. The supply spool 30 is mounted on frame 18 such that the rod 50 for roller 51 is extended beyond the verticle centerline of the spool 30 so that the roller 51 contacts the supply of cable 12 at a location on a radial of the supply of cable 12 as viewed in FIG. 2. In this way, the roller 51 will not contact the toroidal member 10 and yet the supply spool 30 will be located as close to the toroidal member as possible, and the location of spool 30 in close proximity to the toroidal member 10 lessens the flywheel effect of the spool 30 during the shuttle 14 operational mode. At any one point in time, a circle 104 (FIG. 4), centered on the shaft 19 and passing through the center of the brake pads 100,101, will be tangent to the surface of the roller 51 so that as the roller 51 follows the discharge of the cable, the center of the brake pads 101,101 will follow the outer layer of material. The braking force applied to the brake rotor 102 will vary as the diametral material on the cable is discharged so that the tension on the cable as it is withdrawn from the spool 30 will be substantially uniform.

The shuttle 14, upon which the spool 30 and the braking apparatus 36 are mounted, is rotatably driven about the body of the toroidal member 10 at relatively high speeds which will develop a centrifugal force on the braking apparatus 36 urging the roller 51 centrifugally against the diametral supply of material on the spool 30. In this way, as the material is discharged from the spool 30, the centrifugal force will cause the follower roller 51 to stay in contact with the supply of material and will move the brake portion 38 toward the center of the spool 30 with the center of the brake pads 100,101 in line with the outer surface of the material 12 on the spool 30. The centrifugal force generated by the braking apparatus 36 must be greater than the coefficient of friction of the pads 100,101 on the brake rotor 102 in order for the roller 51 to follow the surface of the material being discharged and to move the brake pads 100,101 radially inboard upon the surface of the brake rotor 12. The movement of the braking apparatus 36 radially inward on the spool 30 and radially outward on the shuttle 14, compensates in some limited respect for weight loss of the cable being discharged to assist in maintaining the balance of the shuttle 14.

The plate 48 has a sidewardly extending tab 105 which aligns with an angled slot 106 formed in the flange 43 supporting the pivot 42. The tab 105 can move between the walls of the angular opening of the slot 106 so as to limit the movement of the plate 48 and the braking apparatus 36, including the roller 51 and the brake portion 38, relative thereto. The angle of the slot 106 is such as to permit the roller 51 to clear the flanges 32 and 34 of the spool 30 to permit removal and attachment of the spool to the spindle 20 and to permit the full range of movement of the roller 51 of the braking apparatus 36 in following the surface of the cable 12 on the spool 30 down to the sleeve 29, and to provide clearance with the carcass 10 in either an operational or at a rest mode.

The weight of the spool 30, cable 12, spindle 20 and braking assembly 36 provides a flywheel effect when the shuttle 14 is rotating which aids in reducing speed fluctuations so as to minimize acceleration-deceleration effect on the tension in the cable as it is withdrawn from the spool.

INDUSTRIAL APPLICABILITY

A braking apparatus 36 is provided on a rotating shuttle 14, or the like, and includes a follower roller 51 bearing on a supply of material 12 on a spool 30, likewise carried by the shuttle 14, with the roller 51 mounted radially inward from the center of the spool 30 so that rotation of the shuttle 14 will apply centrifugal force on the roller 51 to urge the roller 51 against the surface of material 12 being discharged. The braking apparatus 36 includes brake pads 100,101 in contact with the brake rotor 102 which rotates with the spool 30 so that as the material 12 is discharged from the spool 30, the force applied by the brake pads 100,101 on the rotor 102 will permit the cable 12 to be withdrawn from the spool 30 under uniform tension. The brake pads 100,101 following the roller 51 which, in turn, follows the diametral surface of the material being discharged, creating uniform resistance in the cable being discharged. The braking apparatus 36 operates on centrifugal force which must exceed the braking force of the pads 100,101 on the rotor 102 so that the roller 51 will follow the surface of the material 12 being discharged and move the brake pads 100,101 along the rotor 102 in a uniform manner. An adjustment 92 is provided for varying the loading of the brake pads 100,101 on the rotor 102.

Other aspects, objects and advantages of this invention can be obtained from a study of the drawings, the disclosure and the appended claims.

We claim:

1. In an apparatus for applying a tension to a material (12) being wound on a member (10), a shuttle (14) rotatably driven about said member (10), a shaft (19) carried by said shuttle (14) and extending transverse thereto, and a spool (30) upon which said material (12) is stored is rotatably supported on said shaft (19), in combination, follower means (40) pivotally mounted on said shuttle (14) in contact with the material (12) on said spool (30), said follower means (40) contacting said material (12) on the side of the spool (30) closest to the axis of rotation of said shuttle (14), rotor means (102) carried by the shaft (19) and being rotatable with the spool (30), and braking means (38) carried by said follower means (40) and engaging with said rotor means (102) for applying a braking force to the rotor means (102) and to the spool (30), said follower means (40) receiving centrifugal force upon rotation of said shuttle (14) to urge said follower means (40) against said material on the spool (30).

2. In an apparatus as set forth in claim 1 wherein said follower means (40) comprises a roller (51) rotatably mounted on a rod (50) pivotally carried on a shaft (42) projecting from the shuttle (14), said roller (51) contacting said material under said centrifugal force.

3. In an apparatus as set forth in claim 1 wherein said braking means (38) comprises:

a pair of arms (66,68) having one end of each pivotally mounted on said follower means (40) and each having another end receiving brake pads (100,101) in engagement with said rotor means (102), and load means (89) located intermediate to the ends of said arms (66,68) for urging said brake pads (100,101) against said rotor means (102).

4. In an apparatus as set forth in claim 3 wherein said follower means (40) comprises a roller (51) rotatably mounted on a rod (50), and includes a plate (48) carried by said rod (50), sleeve means (82) carried by said plate (48), and said sleeve means (82) pivotally mounting said one end of each of said pair of arms (66,68).

5. In an apparatus as set forth in claim 3 wherein said load means (89) comprises:

a member (92) passing through an intermediate portion of one arm (68) and being connected to an intermediate portion of the other arm (66), and spring means (95) on said member (92) for urging said one arm (68) toward said other arm (66).

6. In an apparatus as set forth in claim 1 wherein said braking means (38) has a centerline in axial alignment with the surface of the material (12) on said spool (30) as said follower means (40) contacts said surface of the material (12).

7. In a braking apparatus (36) for applying a substantially uniform tension to a cable (12) being wound on the surface of a toroidal member (10), a shuttle (14) rotatably driven about the body of the toroidal member (10) in a plane substantially transverse to said body, a shaft (19) extending transverse to said shuttle (14), and a spool (30) rotatably supported on said shaft (19) and having a supply of said cable (12) wound thereon, in combination:

a braking apparatus (36) pivotally mounted on said shuttle (14), follower means (40) on said braking apparatus (36) contacting said cable (12) on said spool (30) on the side of the spool (30) closest to the axis of rotation of said shuttle (14), rotor means (102) carried by the shaft (19) and rotatable with the spool (30), and braking means (38) on said braking apparatus (36) engaging with the rotor means (102) for applying a braking force to the rotor means (102), said braking apparatus (36) receiving centrifugal force as said shuttle (14) is rotated to urge said follower means (40) against said cable on the spool (30), and said follower means (40) moving said braking means (38) toward the center of the spool (30) as the cable (12) is drawn from the spool (30) under substantially uniform tension.

8. In a braking apparatus (36) as set forth in claim 7 wherein said follower means (40) comprises a shaft (42) projecting from the shuttle (14), a rod (50) pivotally carried on said shaft (42), and a roller (51) rotatably mounted on said rod (50), said roller (51) contacting said cable (12) under said centrifugal force.

9. In a braking apparatus (36) as set forth in claim 7 wherein said braking means (38) comprises:

sleeve means (82) carried by said follower means (40), a pair of arms (66,68) having one end of each in engagement with said sleeve means (82), brake pads (100,101) carried by another end of each arm (66,68) for engagement with said rotor means (102), and load means (89) operative between said arms (66,68) for urging said brake pads (100,101) against said rotor means (102).

10. In a braking apparatus (36) as set forth in claim 9 including a plate (48) fastened to said follower means (40) for supporting said sleeve means (82).

11. In a braking apparatus (36) as set forth in claim 9 wherein said load means (89) comprises:

a threaded member (92) passing through an intermediate portion of one arm (68) and being threaded into an intermediate portion of the other arm (66), and spring means (95) urging said one arm (68) toward said other arm (66) whereby adjusting said threaded member (92) loads said spring means (95) for changing the braking force of said brake pads (100,101) against said rotor means (102).

12. In a braking apparatus (36) as set forth in claim 7, wherein said braking means (38) has an axial centerline in alignment with the surface of the cable (12) on said spool (30) as said follower means (40) contacts said surface of the cable (12).

* * * * *

UNITED STATES PATENT AND TRADEMARK OFFICE

CERTIFICATE OF CORRECTION

PATENT NO. : 4,264,399

DATED : APRIL 28, 1981

INVENTOR(S) : SAMUEL B. STEVENS and RICHARD W. KIZER

It is certified that error appears in the above-identified patent and that said Letters Patent are hereby corrected as shown below:

Column 4, line 60, delete "101" (first occurrence) and substitute therefor -- 100 --

Column 5, line 15, delete "12" and substitute therefor -- 102 --

Column 6, line 28, Claim 2, after "50" insert -- and --

Signed and Sealed this

*Second* Day of *March 1982*

[SEAL]

*Attest:*

GERALD J. MOSSINGHOFF

*Attesting Officer* *Commissioner of Patents and Trademarks*